United States Patent [19]

Asari et al.

[11] Patent Number: 4,537,569

[45] Date of Patent: Aug. 27, 1985

[54] HOT ISOSTATIC PRESSING APPARATUS

[75] Inventors: Akira Asari, Osaka; Hidehiro Tsuzuki, Kobe; Yoichi Inoue, Hyogo; Takahisa Tabuchi, Kobe, all of Japan

[73] Assignee: Kabushiki Kaisha Kobe Seiko Sho, Kobe, Japan

[21] Appl. No.: 555,620

[22] Filed: Nov. 28, 1983

[30] Foreign Application Priority Data

Jan. 7, 1983 [JP] Japan ..... 58-968[U]

[51] Int. Cl.[3] ..... B30B 11/00

[52] U.S. Cl. ..... 425/405 H; 425/78; 425/411

[58] Field of Search ..... 425/78, 405 H, 411, 425/436 RM, 406, DIG. 200, DIG. 201

[56] References Cited

U.S. PATENT DOCUMENTS

| | | | |
|---|---|---|---|
| 3,550,199 | 12/1970 | Landa | 425/405 H |
| 3,577,842 | 5/1971 | Nakai et al. | 425/78 |
| 3,677,674 | 7/1972 | Bowles | 425/78 |
| 3,695,597 | 10/1972 | Lundstrom | 425/78 |
| 3,698,843 | 10/1972 | Bowles et al. | 425/405 H |
| 3,713,193 | 1/1973 | Chiba et al. | 425/78 |
| 3,732,068 | 5/1973 | Larker | 425/78 |
| 3,804,570 | 4/1974 | Hoschele et al. | 425/78 |
| 3,865,533 | 2/1975 | Deprez et al. | 425/405 H |
| 3,867,077 | 2/1975 | Deprez | 425/405 H |
| 3,900,189 | 8/1975 | Elmgren et al. | 425/78 |
| 4,063,941 | 12/1977 | Papen | 425/405 H |
| 4,354,818 | 10/1982 | Morris | 425/405 H |

FOREIGN PATENT DOCUMENTS

| | | | |
|---|---|---|---|
| 0109243 | 5/1984 | European Pat. Off. . | |
| 2549048 | 5/1976 | Fed. Rep. of Germany | 425/405 H |
| 96899 | 7/1973 | German Democratic Rep. . | |
| 1517305 | 7/1978 | United Kingdom . | |
| 424657 | 10/1974 | U.S.S.R. | 425/405 H |

OTHER PUBLICATIONS

*Primary Examiner*—Jay H. Woo
*Assistant Examiner*—Jill L. Fortenberry
*Attorney, Agent, or Firm*—Oblon, Fisher, Spivak, McClelland & Maier

[57] ABSTRACT

A hot isostatic pressing apparatus equipped with at least one hot isostatic pressing vessel having a detachable bottom lid and at least one cooling or preheating cylinder or hot isostatic pressing vessel arranged substantially on a central horizontal extension of the former vessel, which apparatus includes a rail provided in front of the former vessel and cylinder or the latter vessel with an interval between the rail and the former vessel and the cylinder or the latter vessel; and a carrier capable of reciprocally travelling between the former vessel and the cylinder or the latter vessel and including a lift frame, a lift provided with the frame and a bottom lid cradle, the cradle being provided in the form of a cantilever with lift and extending to a point underneath the former vessel when the carrier assumes a position in front of the former vessel and to another point underneath the cylinder or the latter vessel when the carrier assumes a position in front of the cylinder or the latter vessel. The above construction permits smooth and free travelling of the carrier and facilitates the overall size reduction and maintenance of the HIP apparatus. Only one carrier is required even if a plurality of HIP vessels or a plurality of HIP vessels and preheating/cooling cylinders is provided so as to improve production efficiency.

4 Claims, 9 Drawing Figures

HOT ISOSTATIC PRESSING APPARATUS

BACKGROUND OF THE INVENTION

1. Field of the Invention

This invention relates to a hot isostatic pressing apparatus (hereinafter abbreviated as "HIP apparatus" for the sake of brevity) adapted to heat a metal or ceramic powder compact or a presintered body thereof to a high temperature in an atmosphere of a high-temperature gas so as to carry out sintering, compression forming, densification or the like.

2. Description of the Prior Art

An HIP apparatus is generally constructed of an HIP treatment vessel and a press frame adapted to hold the vessel under pressure. The treatment vessel houses a heater and a heat-insulating layer. A metal or ceramic powder compact or a presintered body thereof (hereinafter called "object" for simplicity) is placed on the bottom lid of the vessel and a high-pressure inert gas is then charged into the vessel, thereby treating the object at elevated temperature and pressure.

In an HIP apparatus of the above sort, the materials making up its heating facilities such as a heater per se are susceptible to oxidation or sublimation if the bottom lid is lowered to remove a treated object immediately or shortly after completion of its HIP treatment. It is thus indispensable to depressurize the treatment vessel together with a treated object still enclosed therein, to cool down the treatment vessel and treated object over a time period as long as well over ten hours, and then to replace the treated object with a fresh object to be treated. This renders the actual working hours of the expensive HIP vessel, namely, the pressure furnace extremely short. Accordingly, such a conventional HIP apparatus is unavoidably accompanied by an economical disadvantage.

In order to overcome such a disadvantage, the present assignee has already developed an HIP method in which an auxiliary station has been incorporated to effect the preheating or forced cooling at such location and, at the same time, certain improvements have been made to the heat-insulating layer, heater and the like so that, after each HIP treatment, the treated object is immediately removed together with the bottom lid without the necessity of awaiting a reduction in the interior temperature, the treated object and bottom lid are then transferred to a cooling station while isolating the heater and treated object from the surrounding atmosphere and the treatment vessel is on the other hand loaded with a fresh object to be treated. The above HIP method has succeeded in rationalizing the production process.

FIG. 1 illustrates one example of an HIP apparatus equipped with such an auxiliary station. On a table 13', there is mounted an HIP treatment vessel 1 equipped with a top lid 2 and a bottom lid which consists of an upper bottom lid 3 and a lower bottom lid 4. An auxiliary station 15 equipped with a cooling cylinder 11 is arranged on a central horizontal extension of the vessel 1. A carrier 6, which has a center of travel on the central horizontal extension, is provided in such a way that it can travel between the vessel 1 and station 15 along rails 14,14. After completion of each HIP treatment, a press frame 5 is removed from the vessel 1 by means of a press frame moving device 12' and, at a position directly underneath the vessel 1, a mechanism housed within a lifting frame 8 which mechanism includes a lift is driven by a lift motor 10 so that the object, held on the bottom lid, is lowered and removed from the vessel 1. Thereafter, the carrier 6 travels to the auxiliary station 15 by means of a carrier-travelling motor 9 and a car 7.

However, the above HIP apparatus is accompanied by such drawbacks as the requirement of a deep pit as the carrier directly underneath the HIP treatment vessel and the operation and maintenance of its equipment are thus rendered troublesome, thereby encountering inconveniences without exception; and the carrying distance of each object is inevitably long due to the arrangement of the carrier in the pit because the carrier is caused to travel with its center of travelling coinciding with the central horizontal extension of the vessel and auxiliary station. When arranging a plurality of auxiliary stations or treatment vessels side by side on the same central horizontal line, it is necessary to provide a carrier between each two stations or vessels or between each vessel and its corresponding station. An HIP apparatus requires a considerable amount of time for cooling each treated object under pressure. Even if one or more auxiliary stations are incorporated, the HIP apparatus may be used only 2–3 times a day. This means that the carrier is substantially unused, leading to an unavoidable economical demerit.

SUMMARY OF THE INVENTION

The present invention has been completed with a view toward solving the aforementioned problems and its object is to provide an HIP apparatus which requires only one carrier irrespective of the number and the manner of arrangement of the HIP treatment vessels and auxiliary stations and, as opposed to a conventional HIP apparatus of the above-noted sort, does not require any pit. More particularly, a carrier is arranged in a novel manner so that substantial improvements may be made to the working convenience and work efficiency as well as the economy of operation.

In one aspect of this invention, there is thus provided a hot isostatic pressing apparatus equipped with at least one hot isostatic pressing vessel having a detachable bottom lid and at least one auxiliary station or hot isostatic pressing vessel arranged substantially on a central horizontal extension of the former vessel, which apparatus comprises:

a rail provided in front of the former vessel and the station or the latter vessel with an interval between the rail and the extension; and a carrier capable of reciprocally travelling between the former vessel and the station or the latter vessel and including a lift frame, a lift provided with the frame and a bottom lid cradle, said cradle being provided in the form of a cantilever with the lift and extending to a point underneath the former vessel when the carrier assumes a position in front of the former vessel and to another point underneath the station or the latter vessel when the carrier assumes a position in front of the station or the latter vessel.

In the HIP apparatus according to this invention, the carrier is so arranged that it can freely travel horizontally between the former treatment vessel and the auxiliary station or the latter treatment vessel. On the other hand, the carrier has the bottom lid cradle which extends in the form of a cantilever in a direction perpendicular to the travelling direction of the carrier. Compared with the prior art apparatus, the HIP apparatus according to this invention has the following advantageous effects:

(1) Since the carrier is of the off-center transfer system, i.e., the center of the carrier base is deviated from the central horizontal extension of the HIP vessel and the like when the carrier travels, the carrier is allowed to move without any obstruction between the position of the HIP treatment and the position of the auxiliary station. Moreover, the carrier can more closely approach the HIP apparatus than the conventional type, thereby facilitating the overall size reduction and maintenance of an HIP apparatus;

(2) Only one carrier is required to treat objects in a plurality of HIP vessels or to treat an object in an HIP vessel and then an auxiliary station;

(3) Different from a conventional HIP apparatus equipped with an auxiliary station, the HIP apparatus of this invention does not require any deep pit and may be positioned on the ground. The HIP apparatus of this invention thus provides a good unobstructed view and is hence convenient for observation;

(4) In a vessel frame provided behind the HIP vessel, it is possible to form the vessel frame in such a way that various pieces of equipment, such as a hydraulic unit, a compressor, a valve stand, etc. may be built in the vessel frame. This facilitates the arrangements of the various pieces of equipment thereby straightening up the piping and wiring and making the apparatus attractive to the eyes; and (5) Owing to the adoption of the off-centered system as mentioned above, it is possible to arrange auxiliary stations respectively at both sides with the vessel placed at the midpoint between the auxiliary stations. This enables adoption of a more functional arrangement and shortening of the travelling distance of the carrier in spite of the more complex structure.

The above and other objects, features and advantages of the present invention will become apparent from the following description and the appended claims, taken in conjunction with the accompanying drawings.

DETAILED DESCRIPTION OF THE PREFERRED EMBODIMENTS

Figure 1:
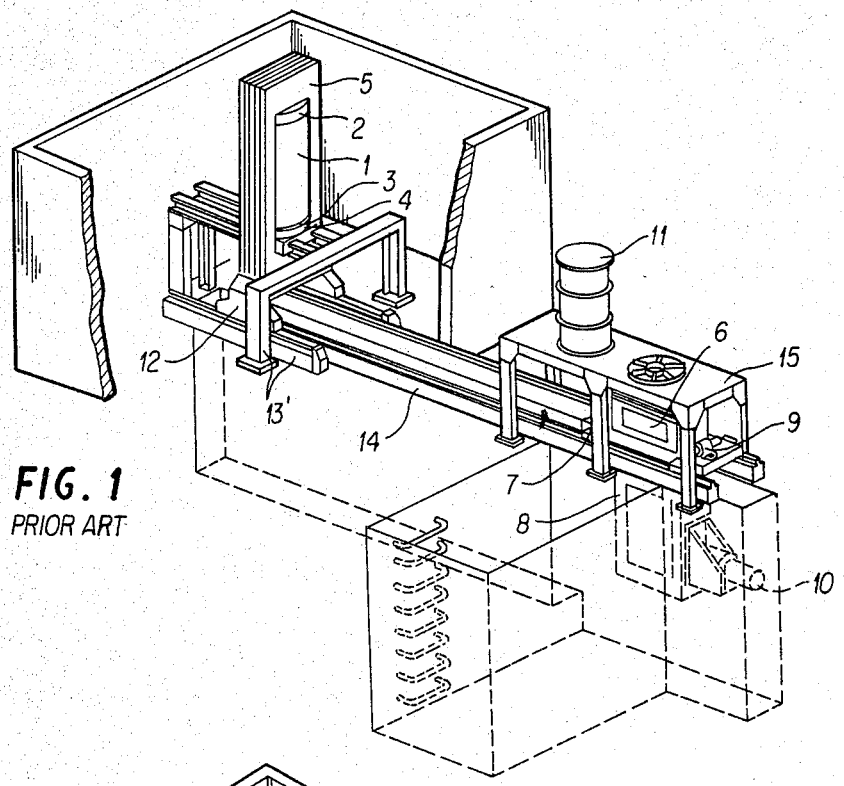
FIG. 1 PRIOR ART
FIG. 1 is a partially cut-away perspective view showing one example of conventional HIP apparatus.
Figure 2:
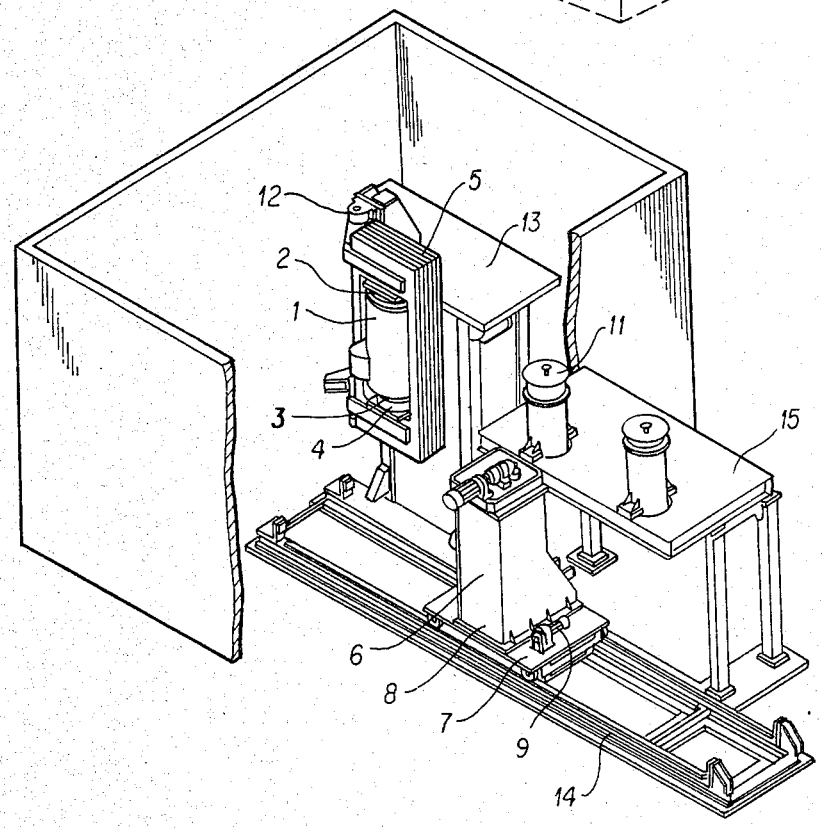
FIG. 2 a perspective view of an HIP apparatus according to one embodiment of this invention.

One embodiment of this invention will now be described with reference to FIG. 2 to FIG. 6 in which like reference numerals identify like elements of the structure in FIG. 1. The HIP vessel 1 equipped with a top lid 2 and the bottom lids 3,4 is supported on a vessel frame 13 which is located behind the HIP vessel 1. Thus, the HIP vessel 1 juts out forward from the vessel frame 13. Auxiliary cylinders 11 (two auxiliary cylinders in the illustrated embodiment) are provided for cooling or preheating purposes substantially on a central horizontal extension of the HIP vessel 1. The auxiliary cylinders 11 are supported on an auxiliary station 15 provided side by side with the vessel frame 13. In front of the vessel 1 and auxiliary cylinders 11, rails 14, 14 along which a hereinafter-described carrier travels are provided with an interval between the rear rail and the central horizontal extension. A carrier 6 is mounted on the rails 14,14 in such a way that it can reciprocally travel between the HIP vessel 1 and the auxiliary cylinders 11 supported on the auxiliary station 15.

On the other hand, numeral 5 indicates a press frame adapted to hold under pressure the HIP vessel 1 while an HIP treatment is carried out in the HIP vessel 1. The vessel 1 is pressed in the press frame 5 during the HIP treatment. The press frame 5 is swingable over an area of at least 90° by means of a swing mechanism 12 so that the HIP vessel 1 may be released before and after each HIP treatment.

It is an important feature of this invention that the rails 14,14 are provided in front of the HIP vessel 1 and the auxiliary station 15, which is located beside the HIP vessel 1, with an interval between the rear rail 14 and the extension. The carrier 6 is thus constructed reflecting the above important feature.

Figure 6:
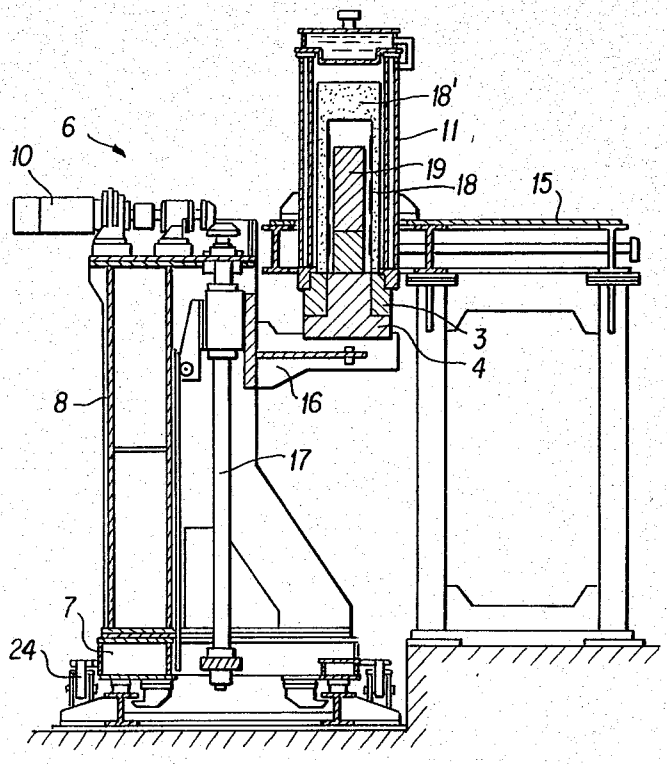
FIG. 6 is a cross-sectional view taken along line B—B of FIG. 3.

Namely, a lift frame 8 is mounted on a car 7 in the carrier 6. The carrier 6 is caused to travel by driving wheels provided on the lower surface of the car 7 and by means of a driving motor 9. Within the lift frame 8, there is housed a lift which is driven by a lift motor 10 mounted on the top of the lift frame 8. As illustrated in FIG. 6, a bottom lid cradle 16 is also provided with its proximal end portion, where it is supported, engaged with a threaded rod 17. The bottom lid cradle 16 has such a front-to-rear length that it extends to a point underneath the HIP vessel 1 when the carrier 6 assumes a position in front of the HIP vessel 1 and to a point underneath each auxiliary cylinder 11 of the auxiliary station 15 when the carrier 6 assumes a position in front of the auxiliary cylinder 11. The bottom lid cradle 16 is therefore moved up and down by turning the threaded rod 17 by the lifting motor 10.

Figure 4:
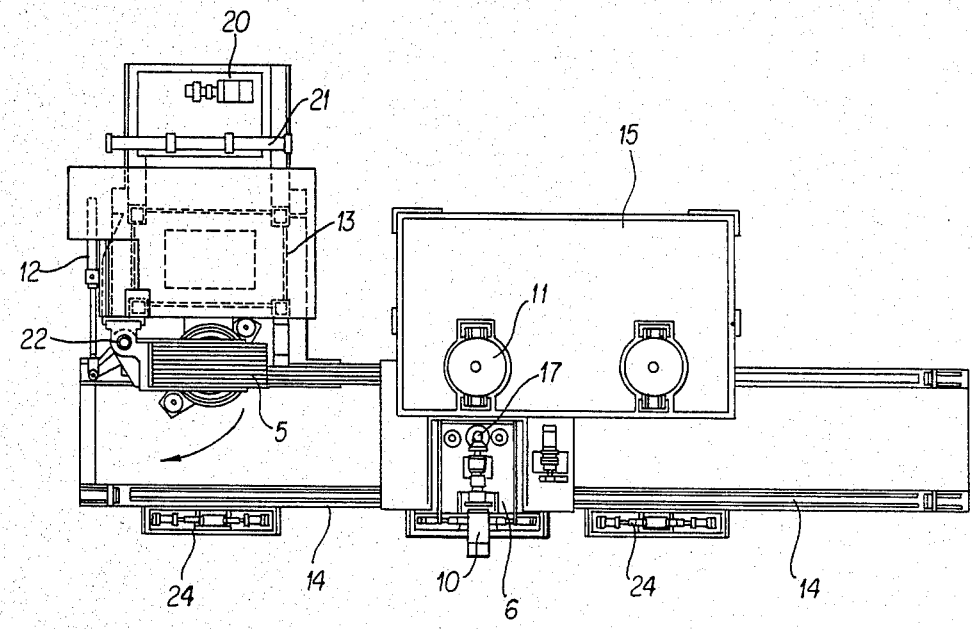
FIG. 4 is a top plan view of the HIP apparatus of FIG. 2.
Figure 5:
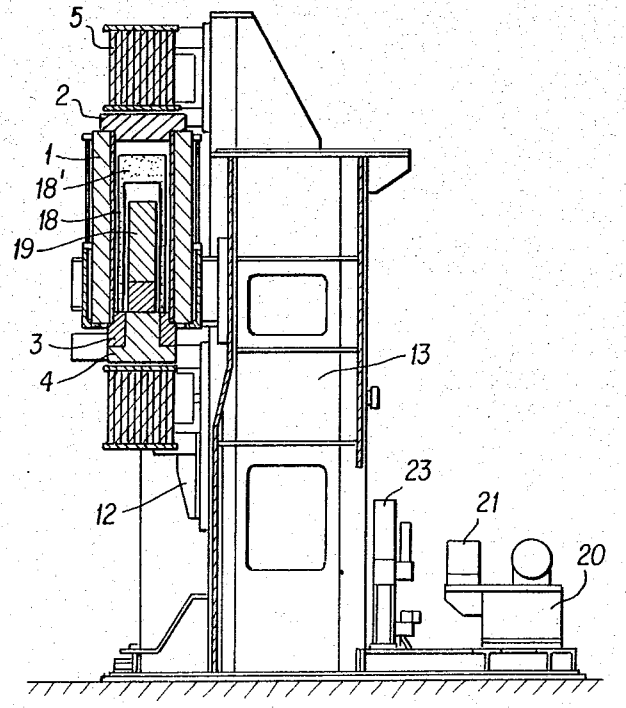
FIG. 5 is a cross-sectional view taken along line A—A of FIG. 3.

Incidentally, numeral 20 which appears in FIG. 5 indicates a hydraulic unit for operating the HIP apparatus. Designated by numerals 21 ad 23 are a compressor and valve stand, respectively. In FIG. 4, numeral 22 indicates a swing shaft for the press frame 5 while numeral 24 indicates positioning stoppers provided with the rails 14.

Operation of the HIP apparatus of the above construction will next be described.

Figure 3:
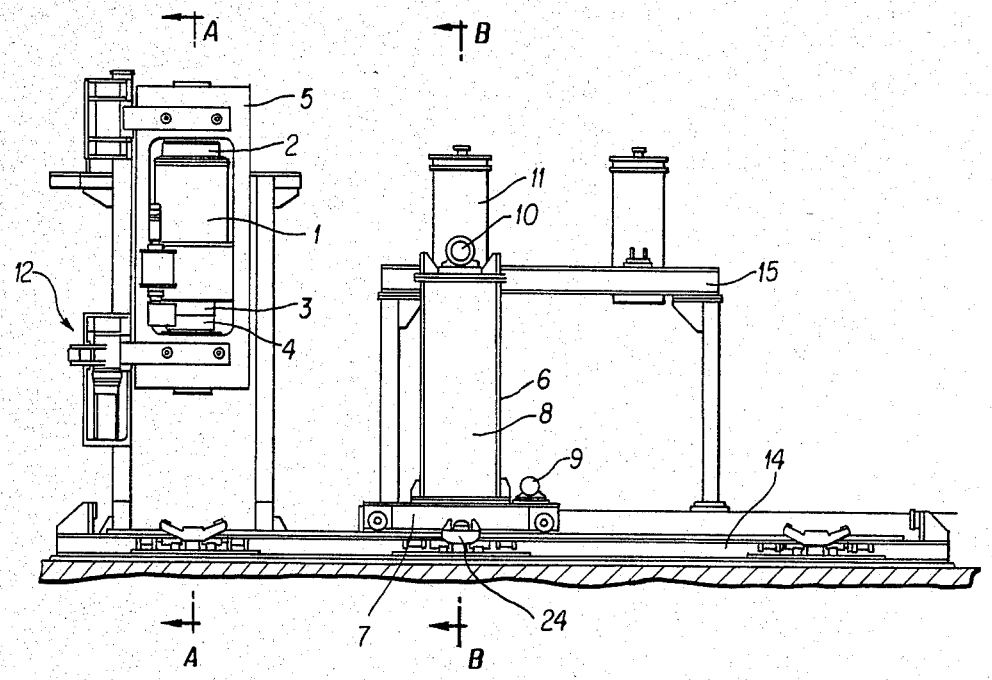
FIG. 3 is a front elevational view of the HIP apparatus of FIG. 2.

Referring first to FIG. 3 and FIG. 4, HIP treatment is now carred out in the HIP vessel 1 while cooling treatment is conducted in one of the auxiliary cylinders, for example, the cooling cylinder 11. The carrier 6 assumes a position in front of the auxiliary station 15.

The HIP treatment is carried out in a manner known commonly in the art by, as illustrated in FIG. 5, using the HIP vessel 1 having a heater 18 and heat-insulating layer 18' enclosed within the HIP vessel 1 with their lower extremities supported integrally on the upper bottom lid 3, placing an object 19, which is to be treated, within the heater 18 and heat-insulating layer 18' and on a table provided on the upper bottom lid 3, and then hermetically holding the top and bottom lids of the HIP vessel 1 under pressure in the press frame 5.

After completion of the HIP treatment, the press frame 5 is swung over an area of 90° in the direction indicated by an arrow in FIG. 4 about the swing shaft 22 by means of the swing mechanism 12 so as to release the HIP vessel 1 and take the treated object out from the HIP vessel 1. Here, the carrier 6 which normally assumes the position in front of the auxiliary station 15 as seen in FIG. 3 and FIG. 4 is located in front of the HIP vessel 1. The treated object 19 is taken out of the HIP vessel 1 by receiving the bottom lids 3, 4 of the HIP vessel 1 on the bottom lid cradle 16 which has been moved by the lift frame 8 to the point underneath the HIP vessel 1. The carrier then travels on the rails 14,14 so as to transfer the treated object 19 together with the bottom lids 3, 4 of the HIP vessel 1 to the auxiliary station 15. The heat-insulating layer 18' and heater 18 are also transferred together with the bottom lids 3, 4 of the HIP vessel 1 where the heat-insulating layer 18' and heater 18 are provided integrally with the bottom lids 3, 4.

The thus-transferred bottom lids 3, 4 reach the point underneath the auxiliary cylinder 11. The bottom lids 3, 4 are then lifted and the cooling of the treated object 19 is carried out in a state illustrated in FIG. 6.

On the other hand, separate bottom lids are provided with the HIP vessel. As soon as loading of the treated object 19 in the auxiliary cylinder 11 has been finished, the carrier 6 is returned to the position in front of the HIP vessel 1 and the next object 19 is then loaded in the HIP vessel by means of the lift.

Where a plurality of auxiliary cylinders 11 is provided at the auxiliary station 15 and loading and unloading of objects 19 into and from the auxiliary cylinders 11 are repeated successively, the above operation is repeated. The above operation is carried out for cooling treated objects. When each auxiliary cylinder 11 is used to preheat objects prior to their HIP treatments, each preheated object is transferred in the opposite direction.

In the above manner, the carrier 6 is allowed to travel from the HIP apparatus to the auxiliary station without encountering any obstacles or problems.

Figure 7:
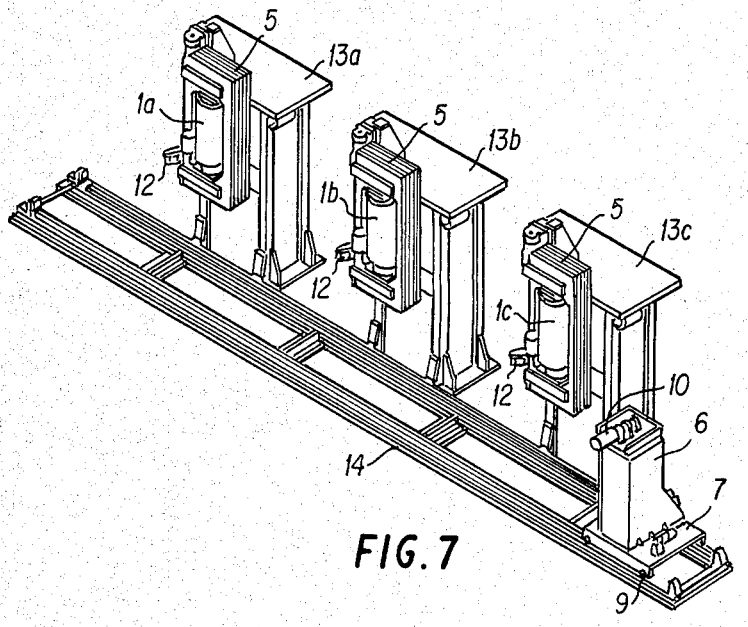
FIG. 7 is a fragmentary perspective view of an HIP apparatus according to another embodiment of this invention.
Figure 9:
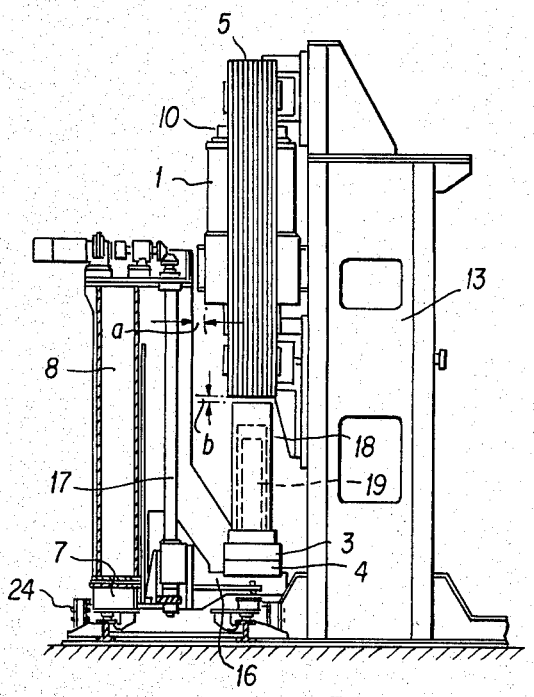
FIG. 9 is a side elevational view, showing the HIP of FIG. 7 in an object-transferring step.
Figure 8:
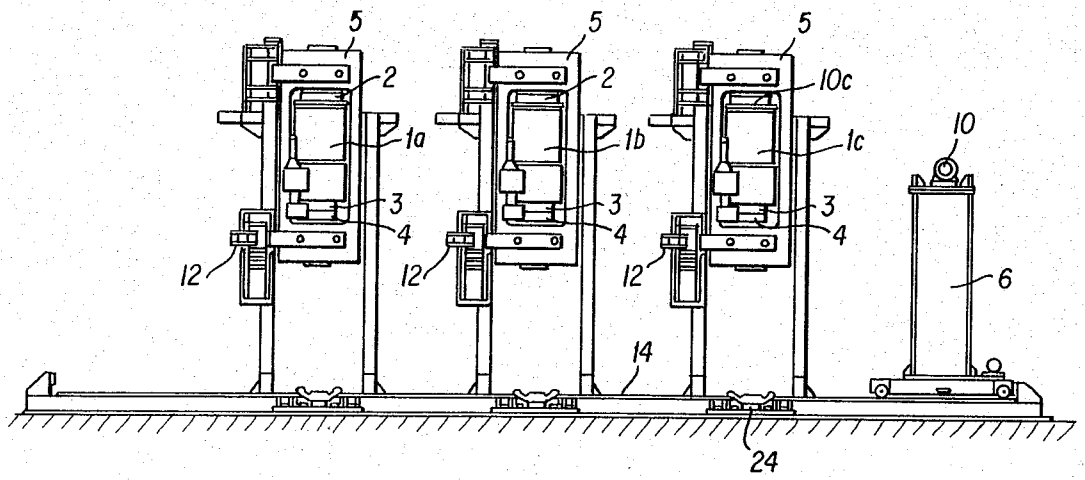
FIG. 8 is a front elevational view of the HIP apparatus of FIG. 7.

A modified embodiment of the HIP apparatus according to this invention is shown in FIG. 7 to FIG. 9. Three HIP vessels **1*a*,1*b*,1*c* are provided side by side. The carrier 6 reciprocates among the HIP vesels 1*a*,1*b*,1*c* along the rails 14,14 laid in front of the HIP vessels 1*a*,1*b*,1*c*. If a time lag is set in the removal timing of a treated object between one HIP vessel and another HIP vessel, the removal of treated objects can be readily carried out by using only one carrier 6. The loading and unloading operations of objects are carried out in the same manner as in FIG. 3 and FIG. 4. In the drawings, like reference numerals identify like elements or structure in FIG. 1 to FIG. 6**.

In the modified embodiment, as shown in FIG. 9, clearances a and b are secured respectively between the lower face of the press frame 5 and the bottom dead end of the lift frame 8 and between the front face of the bottom lids 3, 4 of each HIP vessel and the rear face of the carrier 6 similar to the former embodiment when the carrier 6 assumes a position in front of the HIP vessel. These clearances are provided to permit smooth operation of the apparatus because the bottom lids 3,4 and each treated object can be transferred freely through the spacing between the lower face of each press frame 5 and the bottom dead end of the lift frame 8 of the carrier 6.

Having now fully described the invention, it will be apparent to one of ordinary skill in the art that many changes and modifications can be made thereto without departing from the spirit or scope of the invention as set forth herein.

What is claimed is:

1. A hot isostatic pressing apparatus comprising:

(a) a vessel frame;

(b) a press frame swingably mounted on said vessel frame;

(c) an auxiliary station located adjacent to said vessel frame;

(d) a hot isostatic pressing vessel having a bottom opening mounted in said press frame;

(e) a plurality of detachable bottom lids each of which is sized and shaped to fit into and to plug the bottom opening in said hot isostatic pressing vessel;

(f) a plurality of auxiliary cylinders supported on said auxiliary station along a central horizontal extension of said hot isostatic pressing vessel, said auxiliary cylinders being provided for cooling or preheating purposes, each of said plurality of auxiliary cylinders having a bottom opening sized and shaped so that said detachable bottom lids will fit into and plug the bottom opening in it;

(g) first means for swinging said swingably mounted press frame back and forth between an operative position in which hot isostatic pressing takes place and a transfer position which is spaced laterally of the central horizontal extension of said hot isostatic pressing vessel;

(h) at least one rail running between but beneath and spaced laterally from said swingably mounted press frame when it is in its operative position and beneath and laterally spaced from said plurality of auxiliary cylinders; and (i) a carrier movably mounted on said at least one rail for movement between said press frame and said plurality of auxiliary cylinders, said carrier comprising:

(i) a car which engages said at least one rail and which is laterally spaced from the central horizontal extension of said hot isostatic pressing vessel;

(ii) second means for driving said car reciprocally in either direction along said at least one rail;

(iii) a lift frame mounted on said car;

(iv) a bottom lid cradle cantileveredly mounted on said lift frame so as to extend laterally therefrom such that, when said carrier is positioned adjacent said press frame, said bottom lid cradle extends beneath the transfer position of said press frame and, when said carrier is positioned adjacent one of said plurality of auxiliary cylinders, said bottom lid cradle extends beneath said one or said auxiliary cylinders; and (v) third means for driving said bottom lid cradle reciprocally up and down on said lift frame beteween one or more upper transfer positions and a lower carrying position; whereby:

(j) when said press frame is located in its transfer position and said carrier is located adjacent to said press frame with said bottom lid cradle located in an upper transfer position, one of said detachable bottom lids and an object to be treated located on said one of said detachable bottom lids can be loaded into or removed from said hot isostatic pressing vessel;

(k) when said carrier is located adjacent to one of said plurality of auxiliary cylinders with said bottom lid cradle located in an upper transfer position, one of said detachable bottom lids and an object to be treated located on said one of said detachable bottom lids can be loaded into or removed from said one plurality of auxiliary cylinders; and (l) an object to be treated located on one of said detachable bottom lids can be transferred back and forth between said hot isostatic pressing vessel and said plurality of auxiliary cylinders while said bottom lid cradle is in its lower carrying position and an object to be treated located thereon is beneath and out of the way of said hot isostatic pressing vessel and said plurality of auxiliary cylinders.

2. A hot isostatic pressing apparatus as recited in claim 1 wherein said second means comprises a plurality of drive wheels rotatably mounted on said car and a driving motor mounted on said carrier and operatively connected to at least one of said plurality of drive wheels.

3. A hot isostatic pressing apparatus as recited in claim 1 wherein said third means comprises a threaded rod.

4. A hot isostatic pressing apparatus as recited in claim 1 and further comprising a plurality of positioning stoppers, at least one of which is provided adjacent said at least one rail in position to selectively stop said carrier adjacent to said press frame and others of which are provided adjacent said at least one rail in position to selectively stop said carrier adjacent to each of said plurality of auxiliary cylinders.

* * * * *